United States Patent [19]

Brambring et al.

[11] 4,242,613

[45] Dec. 30, 1980

[54] CRT CONTROL GRID HAVING ORTHOGONAL OPENINGS ON OPPOSITE SIDES

[75] Inventors: Jörg Brambring; Robert F. L. M. van der Ven, both of Eindhoven, Netherlands

[73] Assignee: U.S. Philips Corporation, New York, N.Y.

[21] Appl. No.: 961,435

[22] Filed: Nov. 16, 1978

[30] Foreign Application Priority Data

Nov. 24, 1977 [NL] Netherlands ..... 7712943

[51] Int. Cl.[3] ..... H01J 29/02; H01J 29/56

[52] U.S. Cl. ..... 313/447; 313/448; 313/458

[58] Field of Search ..... 313/458, 447, 448, 449; 314/447, 448, 449, 458, 460

[56] References Cited

U.S. PATENT DOCUMENTS

| | | | |
|---|---|---|---|
| 3,852,608 | 12/1974 | Johanns et al. | 313/449 |
| 3,866,081 | 2/1975 | Hasker et al. | 313/458 X |
| 3,919,583 | 11/1975 | Hasker et al. | 313/448 |
| 3,978,367 | 8/1976 | Jariwala | 313/449 |

*Primary Examiner*—Robert Segal

*Attorney, Agent, or Firm*—Simon L. Cohen

[57] ABSTRACT

The haze around the electron beam spot in the corners and at the edge of the display screen is reduced by using in the electron gun a first grid of a construction such that a multipole lens which is mainly a first quadrupole lens is formed in cooperation with the cathode. The first grid in cooperation with the second grid also forms a multipole lens which is also a mainly second quadrupole lens and which is rotated 90° with respect to the first quadrupole lens. Such a system of lenses in the first grid can be formed, for example, by providing in the first grid an aperture with elongated openings both on the side of the cathode and on the side of the second grid. The longitudinal axis of the elongated opening on the side of the cathode is substantially at right angles to the longitudinal axis of the elongated opening on the side of the second grid.

8 Claims, 18 Drawing Figures

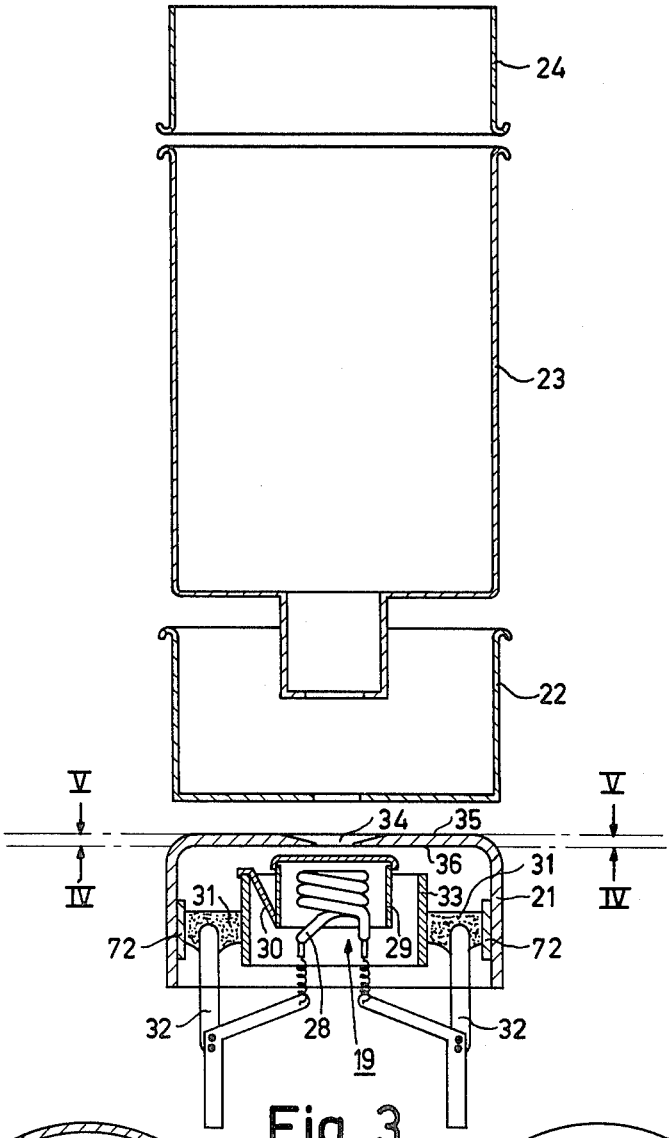
Fig. 3
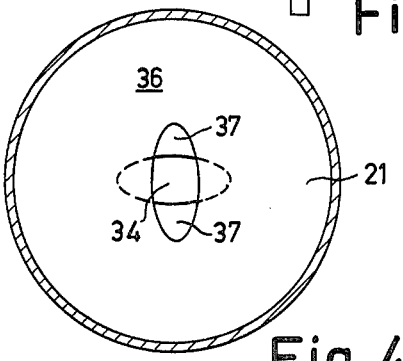
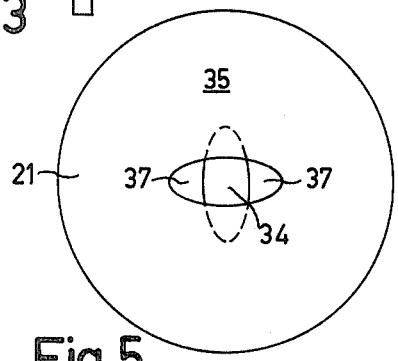
Fig. 4 Fig. 5

CRT CONTROL GRID HAVING ORTHOGONAL OPENINGS ON OPPOSITE SIDES

The invention relates to a cathode-ray tube comprising, in an evacuated glass envelope, an elecron gun to generate an electron beam directed onto, a target the electron gun being comprised at least of a cathode which is centered substantially around an axis and has an emissive surface of which is substantially normal to the axis, a first grid and a second grid, the first grid in cooperation with the cathode and the second grid forming non-rotationally symmetrical electron lenses.

Such a cathode-ray tube may be used for displaying television pictures or in an oscilloscope. In that case the target is a display screen having a phosphor layer or a patern of phosphors luminescing in different colours. Such a cathode-ray tube may also be used for recording television pictures. In that case the target usually is a photoconductive layer. In all such applications it is desired to have a spot of certain dimensions and without a surrounding haze.

Such a cathode-ray tube is disclosed in published Netherlands Patent Application No. 6,717,636. The first grid of the electron gun of the cathode-ray tube described in application is provided with an angular or elliptical aperture which, in cooperation with the cathode and the second grid forms the non-rotationally symmetrical electron lenses to compensate for the astigmatism which arises from a quadrupole lens used for deflection amplification. Such an elongate aperture, however, does not result in strong focusing of the electron beam in two mutually perpendicular directions.

It is therefore an object of the invention to provide a cathode-ray tube with a first grid which makes it possible to strongly focus the beam in two mutually perpendicular directions. Another object of the invention is to provide a cathode-ray tube in which the electron spot is of good quality, that is, a spot having the desired shape and without a surrounding haze.

According to the invention, the cathode-ray tube of the kind mentioned in the first paragraph is provided with a first grid or electrode which in cooperation with the cathode forms a first multipole electron lens which is mainly a quadrupole lens, and, in cooperation with the second grid or electrode, forms a second multipole electron lens which is also mainly a quadrupole lens and which is rotated 90° with respect to the first quadrupole lens.

Two quadrupole lenses rotated 90° with respect to each other can be obtained in several ways. In a first preferred embodiment, the two quadrupole lenses rotated 90° with respect to each other are formed by the provision of an aperture in the first grid having an opening of elongate cross-section both on the side of the cathode and on the side of the second grid. The longitudinal axis of the elongated opening of the aperture on the side of the cathode is normal to the longitudinal axis of the elongated aperture opening on the side of the second grid. By providing such an aperture in an electrode, in an accelerating electric field, a multipole lens is formed which is mainly a quadrupole lens. A first grid of this construction, thus, produces a guadrupole lens on each side of the grid, the two quadrupole lenses being rotated 90° with respect to each other. The depth and the dimensions of the aperture openings in the first grid, the distances to the cathode and the second grid and the potentials on the electrodes determine the strength of the quadrupole lenses. It will be obvious that many desired target shapes can be obtained which are necessary to many types of pick-up and display tubes by variations in the dimensions and depth of the aperture openings.

Colour display tubes generally use three electron guns situated beside each other or arranged in a triangle. These electron guns may have one or more electrodes in common. A gun having a common electrode is disclosed, for example, in U.S. Pat. No. 3,772,554. The invention described hereinafter may also be used in such a gun system.

Moreover, in colour display tubes deflection defocusing often occurs. This is an astigmatic effect on the beam produced by the deflection field. Deflection defocusing results in a serious spot deformation at the edge of the display screen. The astigmatic influence is mainly due to a quadrupole field generated by the deflection coils. The two quadrupole fields produced by the first grid of the invention to a considerable extent compensate for deflection defocusing.

By using a cathode ray tube made in accordance with the invention it is possible to influence the electron beam in a manner such that a spot of very good quality is obained, that is the spot on the display screen is substantially without a surrounding haze and has the desired shape.

It is possible to provide the two elongate mutually perpendicular openings of the aperture in the first grid by means of known methods, for example, by etching or spark erosion. It is also possible to do this by providing elongate recesses in the grid and to connect them together, for example, by drilling.

In a embodiment, the first grid has two, at least partly plate-shaped, parts which are secured together, electrically connected and are provided with mutually perpendicular elongate apertures.

In a third embodiment, the first grid is formed by three, at least partly plate-shaped parts, which are secured together and are electrically connected. The plate-shaped parts disposed on the cathode side and on the side of the second grid are provided with mutually perpendicular elongate apertures and the intermediate part is provided with an aperture having a smallest dimension which exceeds the largest dimension of the elongate apertures.

In a fourth embodiment, the first grid comprises a partly plate-shaped part with a groove on each side, the two grooves extending in mutually perpendicular directions. The depth of the grooves is such that an aperture is formed at the area where the two grooves cross. The grooves may be V or U-shaped.

In a fifth very simple embodiment, the first grid has a portion extending at right angles to the axis which is provided with an aperture centered about the axis and at least one diametrically extending pleat. Since the pleat, viewed from one side, is convex and is concave from the other side, quadrupole lenses rotated 90° with respect to each other are obtained in cooperation with the cathode and the second grid.

A sixth very simple embodiment with a stronger lens system than in the preceding embodiment is obtained by providing a portion of the first grid with two diametrically pleats one of which is concave and the other is convex, the pleats extending in mutually perpendicular directions.

It will be obvious that the two mutually perpendicular openings of the aperture in the first grid can be obtained in many other ways or by or combinations of the methods described above.

The invention will now be described in greater detail with reference to the drawings, in which FIG. 1 is a sectional view of a cathode-ray tube according to the invention, FIG. 2 is a perspective view of a triangular electron gun for a cathode-ray tube according to the invention, FIG. 3 is a sectional view of one of the three guns shown in FIG. 2, FIGS. 4 and 5 are sectional views of FIG. 3, FIGS. 6 to 12 and FIGS. 15 and 16 are a number of sectional views of preferred embodiments of a first grid, FIGS. 13 and 14 illustrate the focusing influences of the first grid according to the invention, and FIGS. 17 and 18 show a spot with and without a haze, respectively.

FIG. 1 is a diagrammatic sectional view of a cathode-ray tube according to the invention, in this case a colour display tube of the in-line type. The tube includes a glass envelope 1 having of a display window 2, a funnel-shaped part 3 and a neck. Mounted in the neck are three electron guns 5, 6 and 7 which generate the electron beams 8, 9 and 10, respectively. The axis of the electron guns are situated in one plane, the plane of the drawing. The axis of the central electron gun 6 coincides substantially with the tube axis 11. The three electron guns debouch into a sleeve 16 which is situated coaxially in the neck 4. The inside surface of the display window 2 is provided with a large number of triplets of phosphor lines. Each triplet has a green-luminescing phosphor, line blue-luminescing phosphor line and a red-luminescing phosphor line. All triplets together constitute the display screen 12. The phosphor lines are normal to the plane of the drawing. Positioned in front of the display screen is the shadow mask 13 which is provided with a very large number of elongate apertures 14 through which pass the electron beams 8, 9 and 10. The electron beams are deflected in the horizontal direction (in the plane of the drawing) and in the vertical direction (normal thereto) by the deflection coil system 15. The three electron guns are positioned so that their axes enclose a small angle with each other. As a result of this, the electron beams pass through the apertures 14 at that angle, the so-called colour selection angle, and each impinges only on phosphor lines of one colour.

FIG. 2 is a perspective view of the three electron guns 5, 6 and 7. The electrodes of the threefold electron gun system are positioned with respect to each other by means of the metal strips 17 which are sealed in the glass assembly rods 18. Each gun comprises a cathode (not visible), a first grid 21, a second grid 22 and grids 23 and 24.

FIG. 3 is a sectional view of one of the guns shown in FIG. 2. The gun includes the first electrode or grid 21 and a rapidly heating cathode 19. A coiled heating filament 28 is situated in the cathode shaft 29 which, opposite the aperture 34, is provided with an emissive surface consisting of a barium-strontium oxide layer. The cathode shaft is secured to the support cylinder 33 by means of three thin metal strips 30. The support cylinder 33 is supported in the first grid 21 by means of glass 31 provided in a metal ring 72. The support rods 32 for connecting the filament in the cathode are also sealed in the glass 31.

The first grid 21 has an aperture 34 which is provided in the electrode by an etching process.

FIG. 4 is a sectional view of FIG. 3 taken along lines IV—IV. As shown in FIG. 4, the surface 36 of the first grid has an aperture opening 37 of elongated cross-section formed by etching an elongated cavity in the material of the electrode.

FIG. 5 is a sectional view of FIG. 3 taken along lines V—V. As shown in FIG. 5 surface 35 of the first grid also has an aperture 34 also with an opening of elongated cross-section. The long axis of the aperture opening in surface 35, however, is normal to the long axis of the elongate aperture opening in the surface 36. This part of the aperture is also formed by etching an elongate cavity 37 in the material of the first grid. The cavities have been etched to such a depth that aperture 34 is obtained. It will be obvious that, if one cavity is made deeper, the other one will be shallower. In this way the strength ratio of the two quadrupoles can be varied and be adapted to the remainder of the system of lenses.

Compared to known tubes with a first grid having an elongate aperture, the first grid according to the invention uses a smaller region of the emissive cathode surface which is approximately equal to the occupied region in a first grid having a circular aperture, while nevertheless the favourable focusing properties of the elongate aperture are maintained.

FIG. 6 shows one embodiment of the first grid used in the cathode-ray tube according to the invention which can be made in a simple manner. In this case the first grid includes of a plate-shaped part 38 having a rectangular aperture 39, as shown in FIG. 7, and of a plate-shaped part 40 which is placed against it and also has a rectangular aperture 42, as shown in FIG. 8. The longitudinal directions of the apertures 41 and 39 are normal to each other and thus form the first grid used in the cathode-ray tube according to the invention.

FIG. 9 shows another embodiment of the first grid which comprises two plate-shaped parts 42 and 46 having therein two mutually, elongate apertures 43 and 47. Positioned between the two plate-shaped parts 42 and 46 is a plate 44 having an aperture 45 which has a dimension exceeding the largest diameter of the elongate apertures.

FIG. 10 is a sectional view of FIG. 9 viewed against the part 46 and aperture 47.

FIG. 11 is a perspective view of another embodiment of the first grid. In this embodiment two mutually perpendicular V or U-shaped grooves 49 and 50 are milled in a metal plate 48 to a depth such that aperture 51 is obtained.

FIG. 12 is also a perspective view of a first grid for a cathode-ray tube according to the invention. The grid comprises a plate 52 having a circular aperture 53. Secured to each side of the plate are two parallel metal strips 54, 55, and 56 57 respectively. The strips 54 and 55 extend at right angles to the strips 56 and 57. The quadrupole lens action of the first grid constructed in this manner is less strong than the quadrupole action of the first grid shown in FIG. 9 under comparable operating conditions.

FIG. 13 shows half of the potential field in the Y-Z plane paths of the electrons leaving the cathode without initial speed in a cathode-ray tube according to the invention. This is in a plane through the tube axis (z-direction) and the longitudinal direction of a first part of an aperture (Y-direction) in the first grid.

In FIG. 14 this is done analogously in the X-Z plane. This is a plane through the tube axis (Z-direction) and the longitudinal direction of the second grid of the aperture (X-direction) in the first grid, which longitudinal direction is at right angles to the longitudinal direction of the first part of the aperture. The electrons leave the cathode surface 57 and pass through the first grid 58 and the second grid 59 along the paths 60. In this case the cathode potential is 30 V, the first grid 58 has a potential of 0 V and the second grid 59 has a potential of 771 V. The potentials of the field are denoted in Volts for the potential lines 61. The distances in the X, Y and Z-directions are denoted in mm. The electron paths and field lines after the second grid 59 are also indicated.

By varying the depth 62 and 63 of the parts of the apertures in the first grid, another focusing is obtained and cross-overs 64 are formed in quide different locations.

FIG. 15 shows a very simple embodiment of a first grid used in the cathode-ray tube according to the invention. The first grid in this case comprises a plate-shaped part 65 which extends at right angles to the axis and has a central aperture 66 for passing the electron beam. As a result of the diametrically extending pleat 67 a double quadrupole lens according to the invention is obtained. Since the pleat is convex on one side and concave on the other side, two quadrupole lenses rotated 90° with respect to each other are produced. In this case the depth of the pleat was 0.2 mm and its width was approximately equal to the diameter of the aperture. The depth may be varied in accordance with the desired lens action.

FIG. 16 shows a second very simple embodiment. The first grid in this case comprises a plate-shaped part 68 which extends at right angles to the tube axis and has a central aperture 69 for passing the electron beam. As a result of the two diametrically extending pleats 70 and 71 a double quadrupole lens according to the invention is also produced. Since the lens actions of the two pleats amplify each other, two quadrupole lenses which are rotated with respect to each other are also formed of a strength larger than the lens strength of the lenses shown in FIG. 15. The depth of the pleats 70 and 71 need not be equal. The shape of the apertures 69 and 66 may also be varied so as to influence the shape of the beam.

Figure 1:
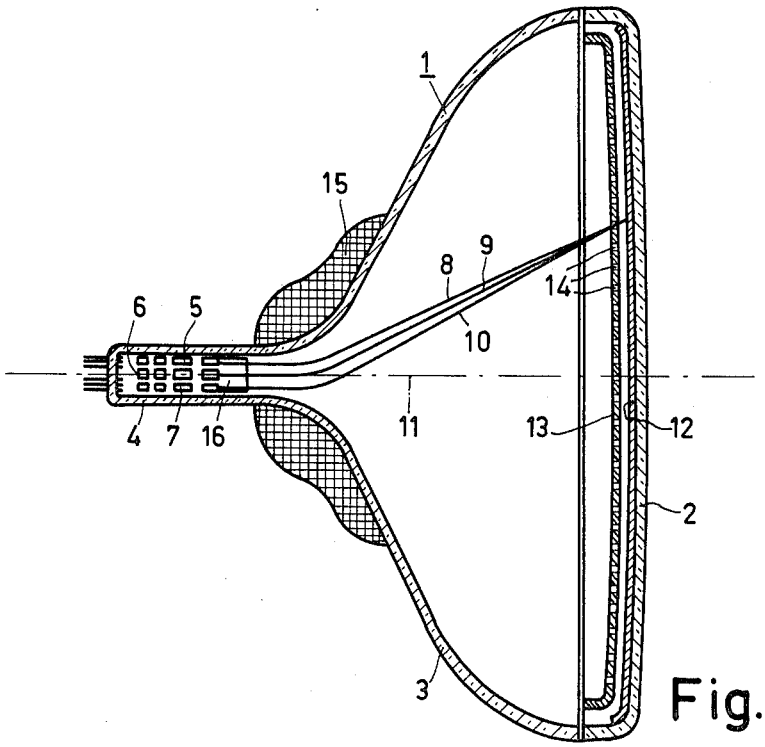
Figure 2:
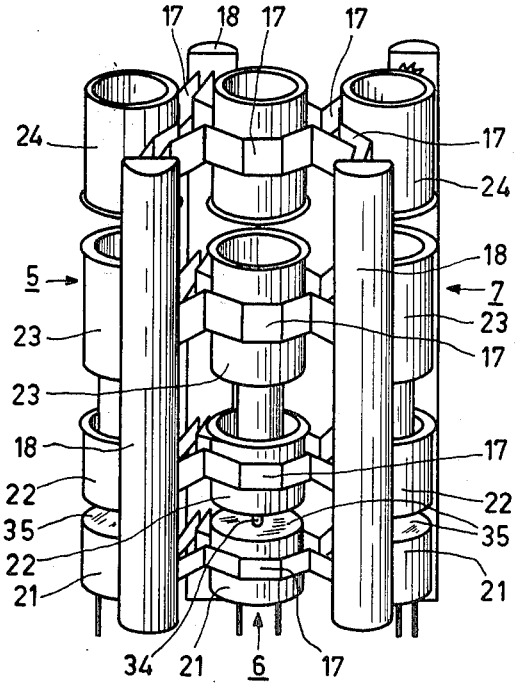
Figure 6:
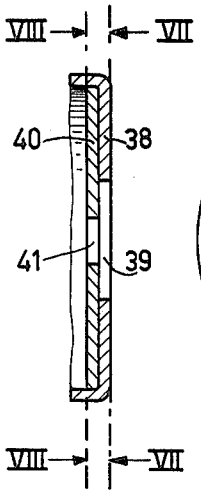
Figure 7:
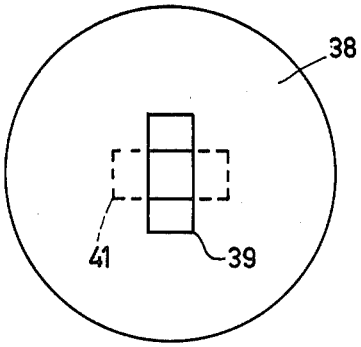
Figure 8:
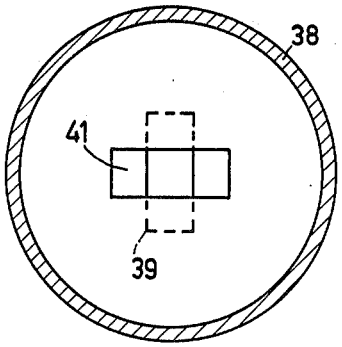
Figure 9:
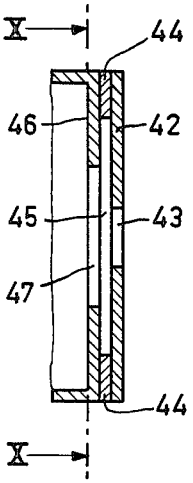
Figure 10:
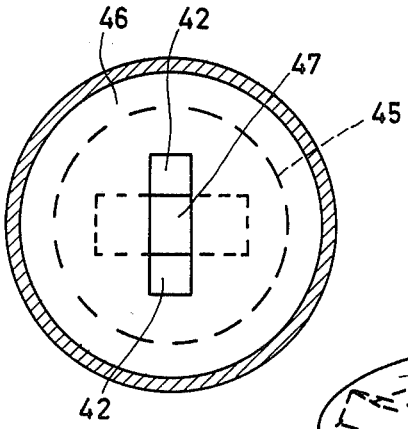
Figure 11:
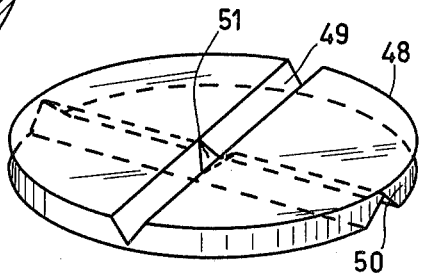
Figure 12:
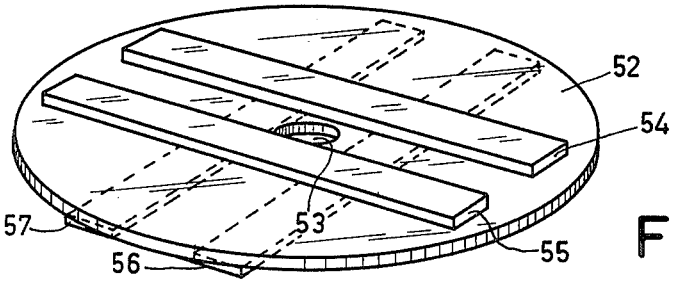
Figure 13:
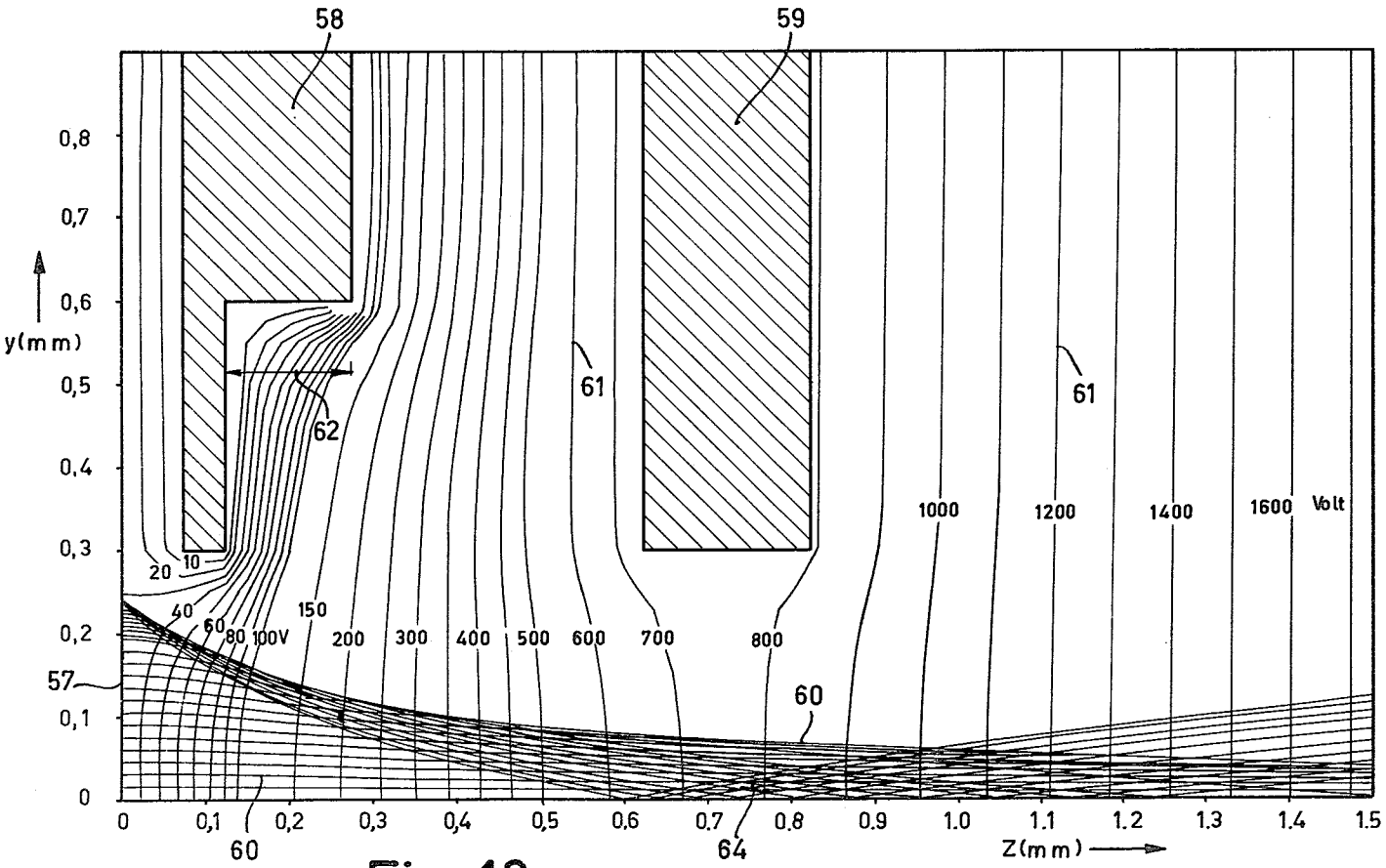
Figure 14:
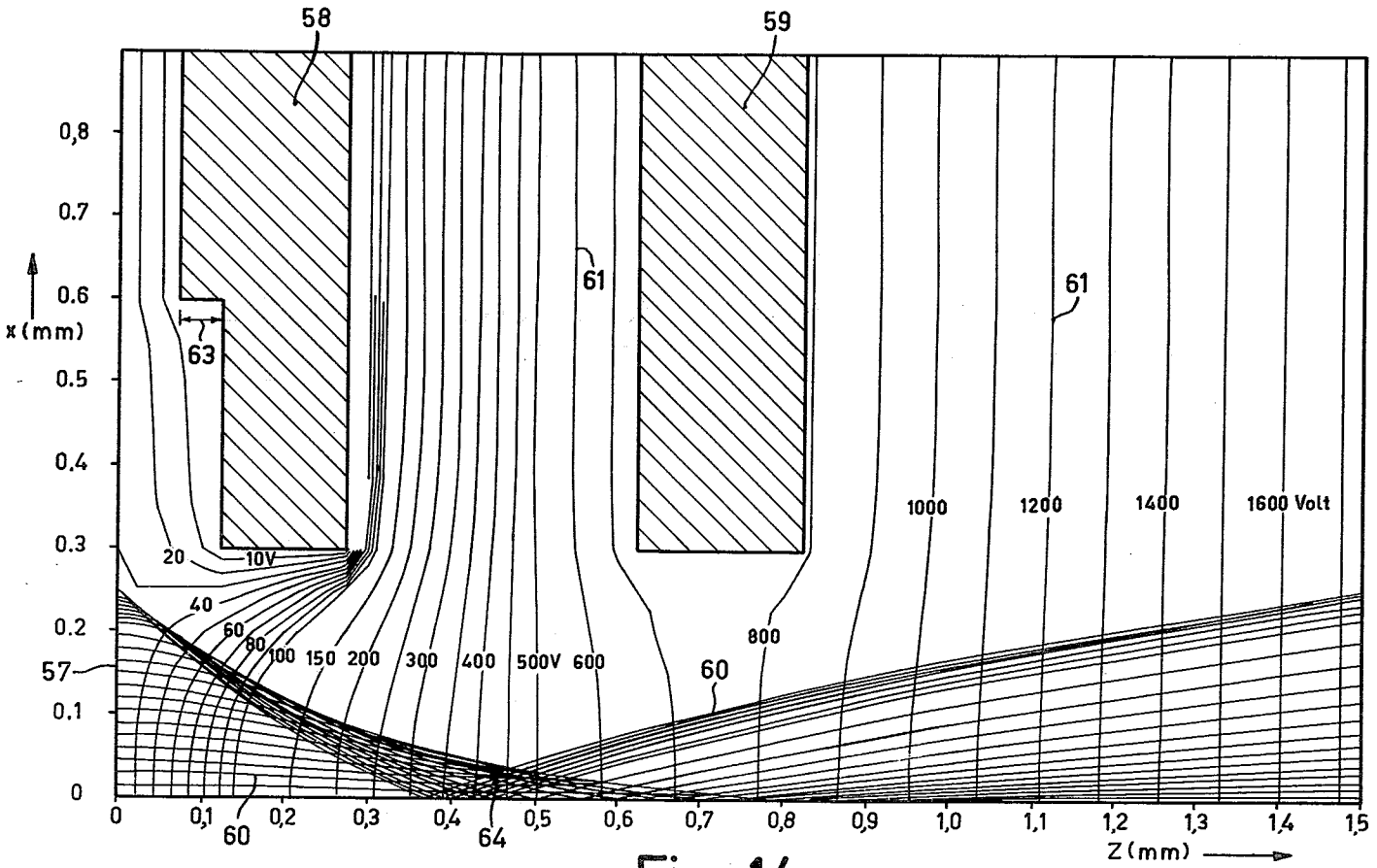
Figure 15:
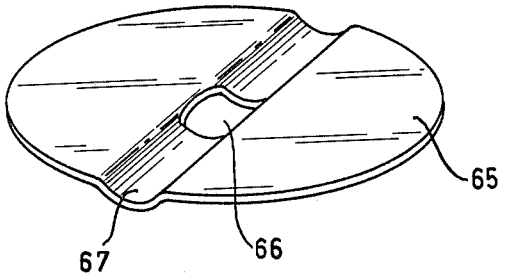
Figure 16:
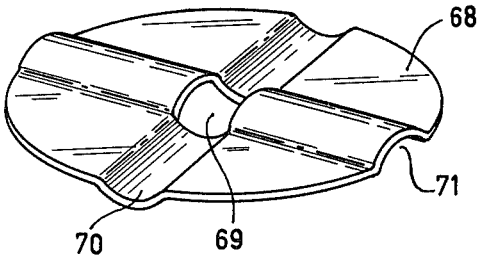
Figure 17:
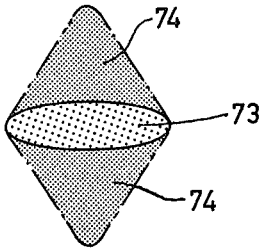
FIG. 17 shows an electron beam spot 73 on a display screen, generated by an electron gun without having a first grid capable of providing a double quadrupole lens.
Figure 18:
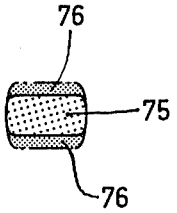
FIG. 18 shows an electron beam spot 75 generated in a cathode ray tube made in accordance with the invention. The haze 76 is negligible and hardly annoying.

We claim:

1. A cathode-ray tube comprising, in an evacuated envelope, a target and an electron gun for generating an electron beam directed onto said target, said electron gun including a cathode centered about a first axis, a first electrode disposed adjacent said cathode and spaced therefrom along said first axis, said first electrode having first aperture centered about said first axis, and a second electrode spaced along said first axis from said first electrode and having a second aperture centered about said first axis, said first electrode having, on the side of said first electrode adjacent said cathode, an elongated opening communicating with said first aperture so that said first electrode and said cathode from a non-rotationally symmetrical multipole electron lens which is mainly a first quadrupole lens and on the side of said first electrode adjacent said second electrode a second elongated opening communicating with said first aperture, the longitudinal axis of said second opening being perpendicular to the longitudinal axis of said first opening so that said first electrode and said second electrode form a non-rotationally symmetrical multipole electron lens which is mainly a second quadrupole lens rotated 90° with respect to said first quadrupole lens.

2. The cathode-ray tube according to claim 1 wherein said first electrode includes two members secured to each other, each of said members having a planar portion which is normal to said first axis and has an elongated aperture formed therethrough, said elongated apertures in said members being generally centered about said first axis to define said first aperture and extending in mutually perpendicular directions, the aperture in the member adjacent said cathode defining said first opening and the aperture in the planar member adjacent said second electrode defining said second opening.

3. The cathode-ray tube according to claim 2 including a third, planar member disposed between said two members and having an aperture formed therethrough of a size larger than the largest dimension of said elongated apertures in said two members.

4. The cathode-ray tube according to claim 2 or 3 wherein said elongated apertures in said two members are rectangular.

5. The cathode-ray tube according to claim 1 wherein said first electrode has a planar portion which is normal to said first axis, said planar portion having a groove formed in each side thereof, said grooves extending at right angles to each other and defining said first and second openings respectively, the depth of the grooves being such that said first aperture is formed at the region of said planar portion where said grooves cross each other.

6. The cathode-ray tube according to claim 1 wherein said first electrode has a planar portion which is normal to said first axis and has a pleat formed therein, said first aperture being formed in said pleat.

7. The cathode-ray tube according to claim 1 wherein said first electrode has a planar portion which is normal to said first axis, said planar portion having a pleat formed in each side thereof, said pleats extending in mutually perpendicular directions, said first aperture being formed in the region of said planar portion at which said pleats cross each other.

8. The cathode-ray tube according to claim 1 wherein said first electrode has a planar portion which is normal to said first axis and a pair of parallel strips secured to each side of said planar portion, the strips of each pair being spaced about said first aperture with the longitudinal axes thereof being perpendicular to the longitudinal axes of the strips of the other pair thereby defining a respective one of said first and second openings.

* * * * *